US007997443B2

(12) United States Patent
Titas et al.

(10) Patent No.: US 7,997,443 B2
(45) **Date of Patent: *Aug. 16, 2011**

(54) CENTER-PULL PAPER TOWEL DISPENSER

(75) Inventors: Richard Petras Titas, Lyndhurst, OH (US); Christopher Andrew Brizes, Westlake, OH (US); Mark Edward Cipolla, Chardon, OH (US); Paul Dana Stephens, Twinsburg, OH (US); Christopher Daniel Carsten, Mason, OH (US)

(73) Assignee: Cintas Corporation, Cincinnati, OH (US)

( * ) Notice: Subject to any disclaimer, the term of this patent is extended or adjusted under 35 U.S.C. 154(b) by 306 days.

This patent is subject to a terminal disclaimer.

(21) Appl. No.: 11/939,120

(22) Filed: Nov. 13, 2007

(65) Prior Publication Data

US 2009/0120951 A1 May 14, 2009

(51) Int. Cl.

| | |
|---|---|
| ***B65H 1/00*** | (2006.01) |
| ***B65H 16/02*** | (2006.01) |
| ***B65H 18/02*** | (2006.01) |
| ***B65H 49/38*** | (2006.01) |
| ***A47K 10/24*** | (2006.01) |

(52) U.S. Cl. ..... 221/45; 221/33; 221/65; 221/62; 225/106; 225/52; 225/96.5; 242/593; 242/615.3; 242/615.4; 242/596.8; 242/132; 242/137; 16/386; 220/253; 222/333; 222/63; 222/105

(58) Field of Classification Search ..... 225/106, 225/52, 96.5; 242/593, 615.3, 615.4, 596.8, 242/132, 137; 16/386; 220/253; 222/333, 222/63, 105; 221/45, 33, 63, 62

See application file for complete search history.

(56) References Cited

U.S. PATENT DOCUMENTS

| | | | | |
|---|---|---|---|---|
| 4,664,304 | A | 5/1987 | Wendt et al. | |
| 4,800,588 | A * | 1/1989 | Poster, Jr. | 379/412 |
| 4,905,868 | A | 3/1990 | Beane et al. | |
| 5,141,171 | A | 8/1992 | Yang | |
| 5,205,455 | A | 4/1993 | Moody | |

(Continued)

OTHER PUBLICATIONS

U.S. Appl. No. 11/939,105, filed Nov. 13, 2007, Titas et al.

*Primary Examiner* — Gene Crawford
*Assistant Examiner* — Rakesh Kumar
(74) *Attorney, Agent, or Firm* — Wood, Herron & Evans, LLP

(57) ABSTRACT

A center-pull dispenser for dispensing paper towels from a continuous roll, wherein each individual towel is separated from an adjoining towel by a plurality of perforations. The dispenser comprises a housing having a housing back and a detachable front cover hingedly connected thereto at the lower periphery of said housing back and front cover for opening and closing the housing, a paper support tray removably connected to a lower portion of the housing back, the tray having a centrally located dispensing nozzle and at least one locking element for releasably locking at least one first hinge element on the lower periphery of the front cover to at least one second hinge element on the lower periphery of the housing back, an opening in the lower periphery of said housing through which the towels are dispensed, and a wall-mounting member for removably mounting the housing back to a wall. In one embodiment, the paper support tray comprises locking arms for releasably locking first hinge elements on the lower periphery of said front cover against second hinge elements on the lower periphery of said housing back. In another embodiment, the dispenser comprises a locking member for releasably locking the front cover to the housing back and the housing back to the wall-mounting member.

20 Claims, 16 Drawing Sheets

U.S. PATENT DOCUMENTS 5,246,137 A 9/1993 Schutz et al.
5,263,607 A 11/1993 Temesvary et al.
5,273,184 A 12/1993 Rizzuto
5,310,083 A 5/1994 Rizzuto
5,335,811 A 8/1994 Morand
5,370,338 A 12/1994 Lewis
5,375,920 A 12/1994 Macchi Cassia
5,630,526 A * 5/1997 Moody ..... 221/45
5,697,576 A 12/1997 Bloch et al.
5,715,971 A 2/1998 Morand
5,765,718 A 6/1998 Grasso et al.
5,857,642 A 1/1999 Zinnbauer
6,024,323 A 2/2000 Palermo, Jr.
6,129,240 A 10/2000 Morand
6,145,782 A 11/2000 King et al.
6,267,321 B1 * 7/2001 Tramontina ..... 242/593
D449,474 S 10/2001 Conran et al.
6,328,252 B1 12/2001 Neveu et al.
6,510,964 B2 1/2003 Paukov et al.
6,517,025 B1 2/2003 Budz
6,575,397 B1 6/2003 Tramontina et al.
6,592,001 B2 7/2003 Lewis et al.
6,629,667 B2 * 10/2003 Tramontina ..... 242/593
6,769,589 B2 8/2004 Paukov
6,869,041 B1 * 3/2005 Allegre et al. ..... 242/593
7,040,568 B2 5/2006 Lewis et al.
7,131,609 B1 11/2006 Lewis et al.
7,275,655 B2 10/2007 Duff
7,275,672 B2 * 10/2007 Haen et al. ..... 225/106
2003/0145429 A1 * 8/2003 Twomey ..... 16/387
2006/0261076 A1 11/2006 Anderson

* cited by examiner

CENTER-PULL PAPER TOWEL DISPENSER

FIELD OF THE INVENTION

The present invention relates to the field of paper towel dispensers, and more specifically to a center-pull dispenser for dispensing paper towels from a continuous roll of towels separated by perforations.

BACKGROUND OF THE INVENTION

Dispensers for paper towels are commonly placed near sinks in lavatories and public restrooms to enable users to dry their hands after washing. Typically, the paper towel dispenser is mounted on a wall adjacent a sink. The dispensers are usually hand operated by the user, and dispense a length of paper towel according to pulling action by the user. Some dispensers are provided with an actuating mechanism for dispensing paper towels. Whatever its design, a dispenser should remain closed when used by the public and be easily opened for refilling by service personnel.

Dispensers have various mechanisms for dispensing paper towels. Some dispensers have a metering mechanism that requires a user to push an activating button or wait a period of time before another paper towel can be pulled from the dispenser. For example, U.S. Pat. No. 4,664,304 describes a metering mechanism having a button that must be depressed by the user for each paper towel dispensed. Such an actuating button is typically connected with a drive mechanism or other moving parts that function in the act of dispensing. U.S. Pat. No. 6,869,041 describes a piston assembly comprising a biasing member and a piston that contacts the tail of a paper towel roll extending through the dispensing opening. However, dispensers having gears and other moving parts to regulate the dispensing of paper towels may be prone to breakage or other dispensing problems.

Thus, there is a continuing need for a simple and reliable paper towel dispenser that provides a user with a single paper towel at a time, and does not require any action by the user other than pulling out the paper towel. The dispenser should be easily mountable on a wall and should remain closed when used by the public and be easily opened for refilling by service personnel. Additionally, a dispenser having no metering mechanism with moving parts should be more reliable and less expensive to manufacture.

SUMMARY OF THE INVENTION

In one embodiment, the present invention relates to a center-pull dispenser for dispensing paper towels from a continuous roll wherein each individual towel is separated from an adjoining towel by a plurality of perforations, said dispenser comprising:

a) a housing having a housing back and a detachable front cover hingedly connected thereto at the lower periphery of said housing back and front cover for opening and closing said housing;

b) a paper support tray removably connected to a lower portion of the housing back, said support tray having a generally planar top surface, a centrally located dispensing nozzle having an orifice for dispensing individual towels therethrough, and at least one locking element for releasably locking at least one first hinge element on the lower periphery of said front cover to at least one second hinge element on the lower periphery of said housing back;

c) an opening in the lower periphery of said housing through which the towels are dispensed; and d) a wall-mounting member for removably mounting the housing back to a wall.

In another embodiment, the invention relates to such a center-pull dispenser wherein the paper support tray comprises locking arms for releasably locking first hinge elements on the lower periphery of the front cover against second hinge elements on the lower periphery of the housing back.

In another embodiment, the invention relates to such a center-pull dispenser further comprising a locking member for releasably locking the front cover to the housing back and the housing back to the wall-mounting member.

DETAILED DESCRIPTION OF THE INVENTION

The present invention will be described with reference to the accompanying drawings, in which embodiments of the invention are shown. The materials, methods and examples described are illustrative in nature and not intended to be limiting. Accordingly, this invention should not be construed as limited to the illustrated embodiments. Other features and advantages of the invention will be apparent from the following detailed description and claims.

Figure 1:
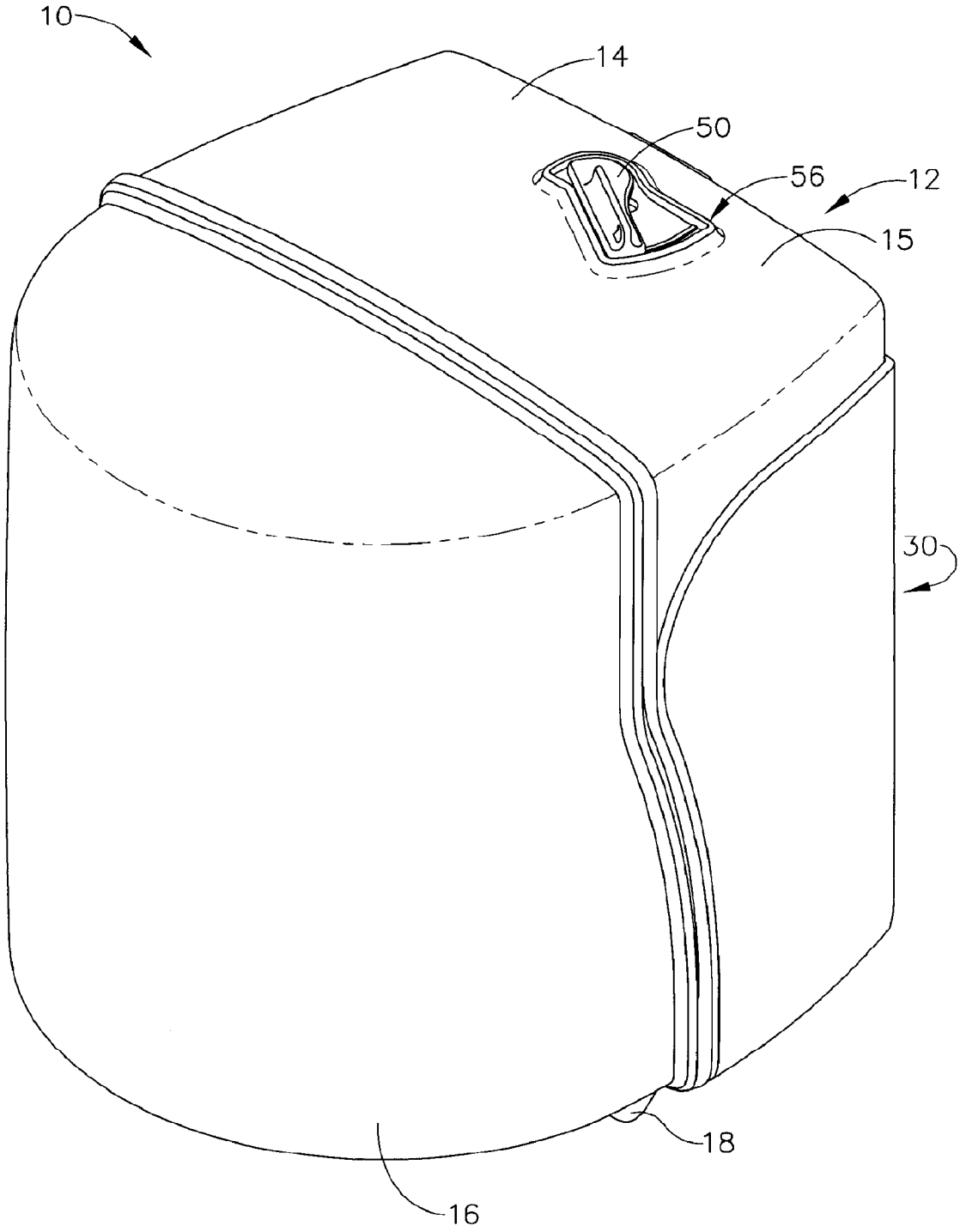
FIG. 1 shows a front perspective view of a center-pull dispenser of the present invention in a closed condition.
Figure 5:
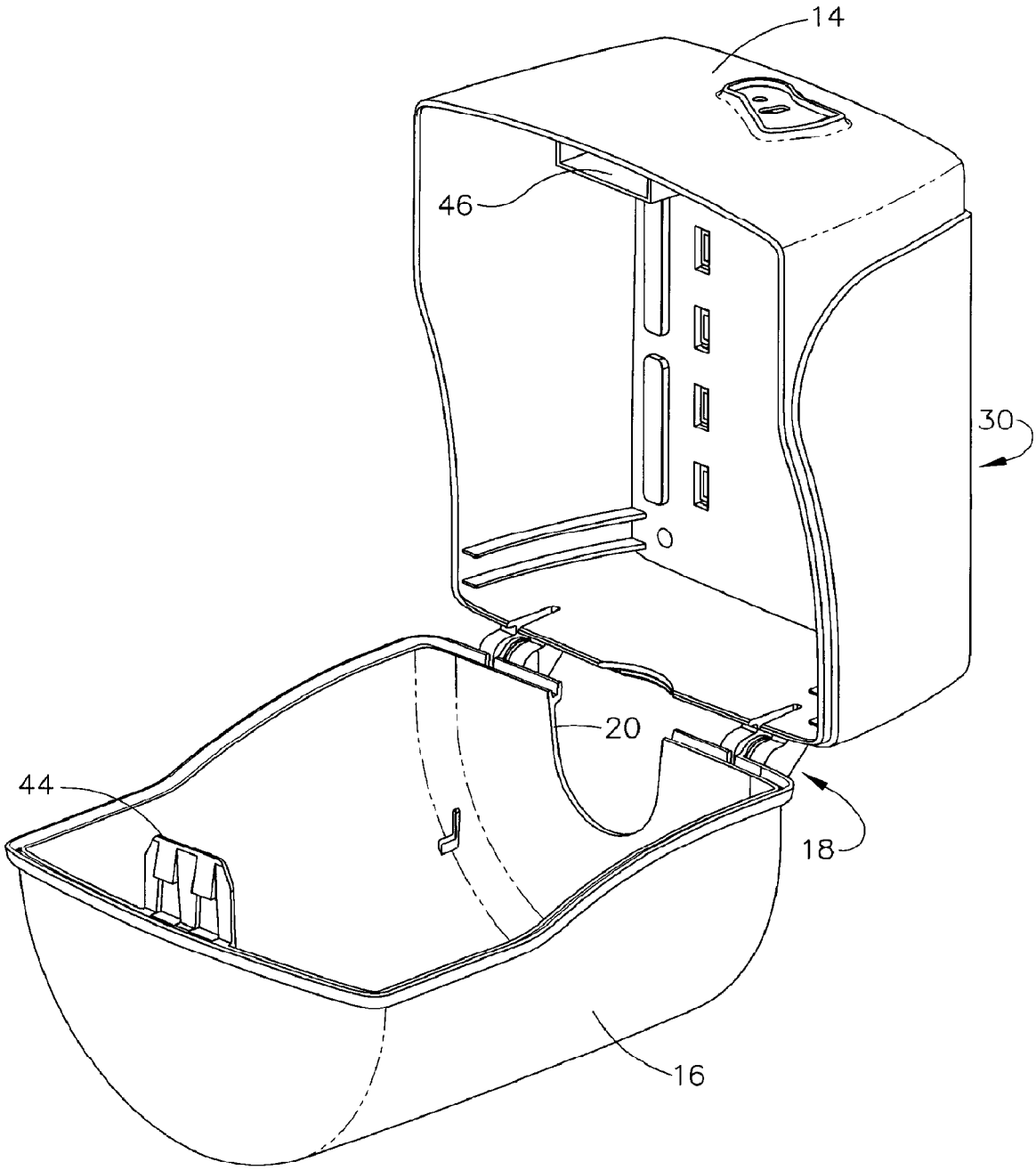
FIG. 5 is a front perspective view of the dispenser of FIG. 1 in an open position, without the opening key and without a paper support tray.

FIG. 1 illustrates one embodiment of the invention showing a dispenser 10 for dispensing paper towels (including dry and moistened towels and wipes) from a continuous roll of towels. Each individual towel is separated from an adjoining towel by a plurality of perforations. Dispenser 10 comprises a cylindrically-shaped housing 12 having a housing back 14 and a front cover 16 hingedly connected to the housing back at its lower periphery through hinges 18 for opening and closing of the housing. An opening 20 (shown in FIG. 5) is positioned in the lower periphery of housing 12 through which the towels are dispensed. As shown in FIG. 5, opening 20 is defined primarily by front cover 16, i.e., the opening occurs primarily in the lower portion of the front cover. Opening 20 is also defined partially by housing back 14. In other embodiments, the opening may be defined entirely by the front cover or the housing back, although the front cover typically at least substantially defines the opening. The dispenser, and usually each component thereof, is typically made of a hard, durable plastic material, such as ABS plastic, molded to the desired shape using known techniques. However, all or portions of the dispenser may be constructed of metal or other durable materials, such as stainless steel or aluminum.

Figure 3:
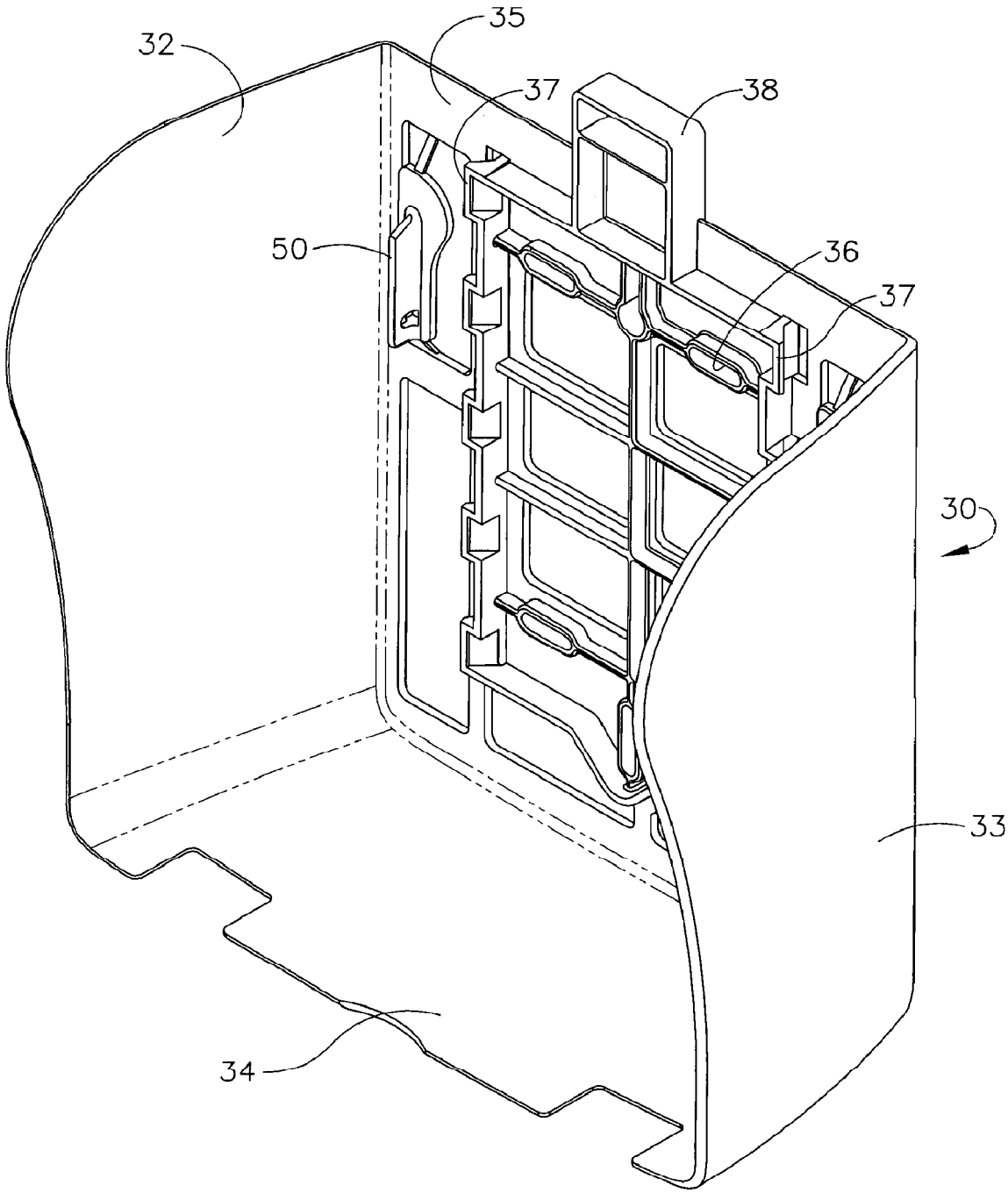
FIG. 3 is a perspective view of the wall-mounting member of the dispenser of FIG. 1.
Figure 19:
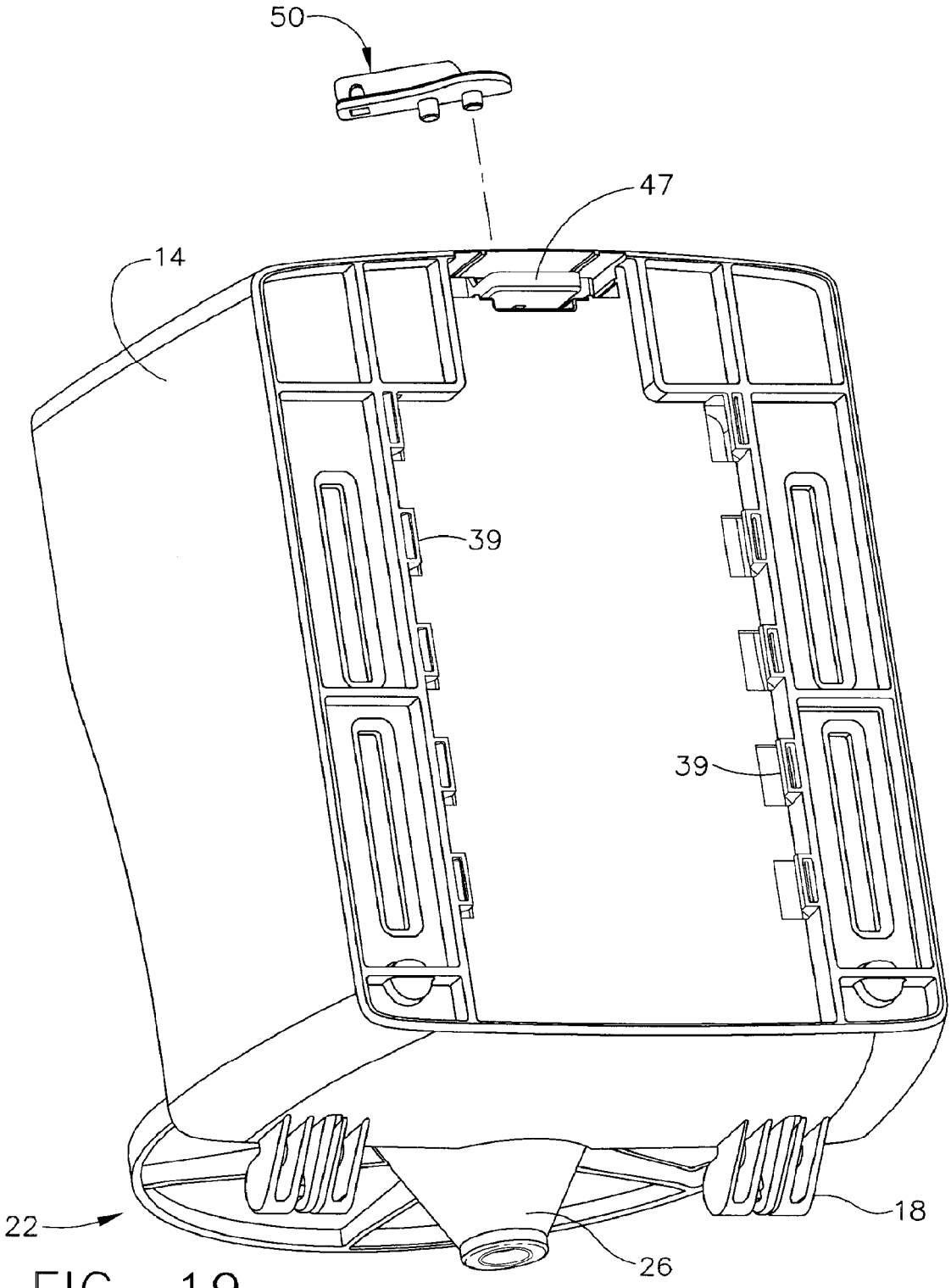
FIG. 19 is a rear perspective view of the housing back and paper support tray of the dispenser of FIG. 6, without the front cover and wall-mounting member attached.

The dispensers of the invention have a wall-mounting member for removably mounting the housing back to a wall. For example, dispenser 10 further comprises a detachable wall-mounting member 30 for supporting housing 12 and removably mounting housing back 14 to a wall. Wall-mounting member 30 typically is releasably engageable with housing back 14 so that the housing back or the full housing 12 may be removed from the wall without removing the wall-mounting member itself from the wall. As illustrated in FIG. 3, wall-mounting member 30 comprises first side panel 32 and second side panel 33, bottom panel 34, and back bracket 35. Back bracket 35 typically has a plurality of openings, such as openings 36, for receiving fasteners (e.g., screws or bolts) to removably affix the wall-mounting member to a wall. Back bracket 35 also has a plurality of outwardly-protruding (i.e., protruding toward the first side panel 32 and the second side panel 33) catches 37 extending generally from an upper portion to a lower portion of its interior side (i.e., the housing-facing side) to receive a plurality of corresponding inwardly-protruding catches 39 on the exterior side (i.e., the wall-facing side) of housing back 14, as shown in FIG. 19. The catches 39 on the housing back fit in the spaces between catches 37 on the back bracket when the housing back is fit flush against the back bracket. After the wall-mounting member is affixed to a wall, the housing back is fit flush against the back bracket of the wall-mounting member and then slid vertically down to engage catches 37 with catches 39, horizontally locking the housing back to the wall-mounting member. The housing back then cannot be removed from the wall-mounting member by pulling it in a horizontal direction away from the wall-mounting member. Wall-mounting member 30 also includes a latch 38 for receiving the back end of slide bar 47 (shown in FIGS. 7 and 19) to vertically lock the housing back to the wall-mounting member. The housing back then cannot be slid vertically upward to disengage catches 37 from catches 39 without pulling slide bar 47 away from latch 38. As shown in FIG. 3, a key 50 for opening the dispenser housing may also be molded into back bracket 35.

In one embodiment of the invention, the dispenser comprises a locking member for releasably locking the front cover of the housing to the housing back. Various locking members known in the art, e.g., the locking mechanism described in U.S. Pat. Nos. 7,275,672 and 6,869,041 and U.S. Patent Application Publication 2006/0261076 A1, all incorporated herein by reference, can be used in the present invention. In another embodiment, the dispenser comprises a locking member for releasably locking the front cover of the housing to the housing back and the housing back to the wall-mounting member. In the dispenser shown in FIG. 1, the top portion 15 of housing back 14 has a locking member 56 positioned to releasably lock front cover 16 to the housing back so that the housing can be securely closed when dispenser 10 is intended for use by the public. Access to the interior of the housing is thus limited to authorized personnel who are able to unlock locking member 56, such as by using key 50 shown in FIG. 1. Locking member 56 also releasably locks housing back 14 to wall-mounting member 30, as described hereinafter. When the locking member is engaged, the housing cannot be removed from the wall-mounting member without first unlocking the locking member.

Figure 6:
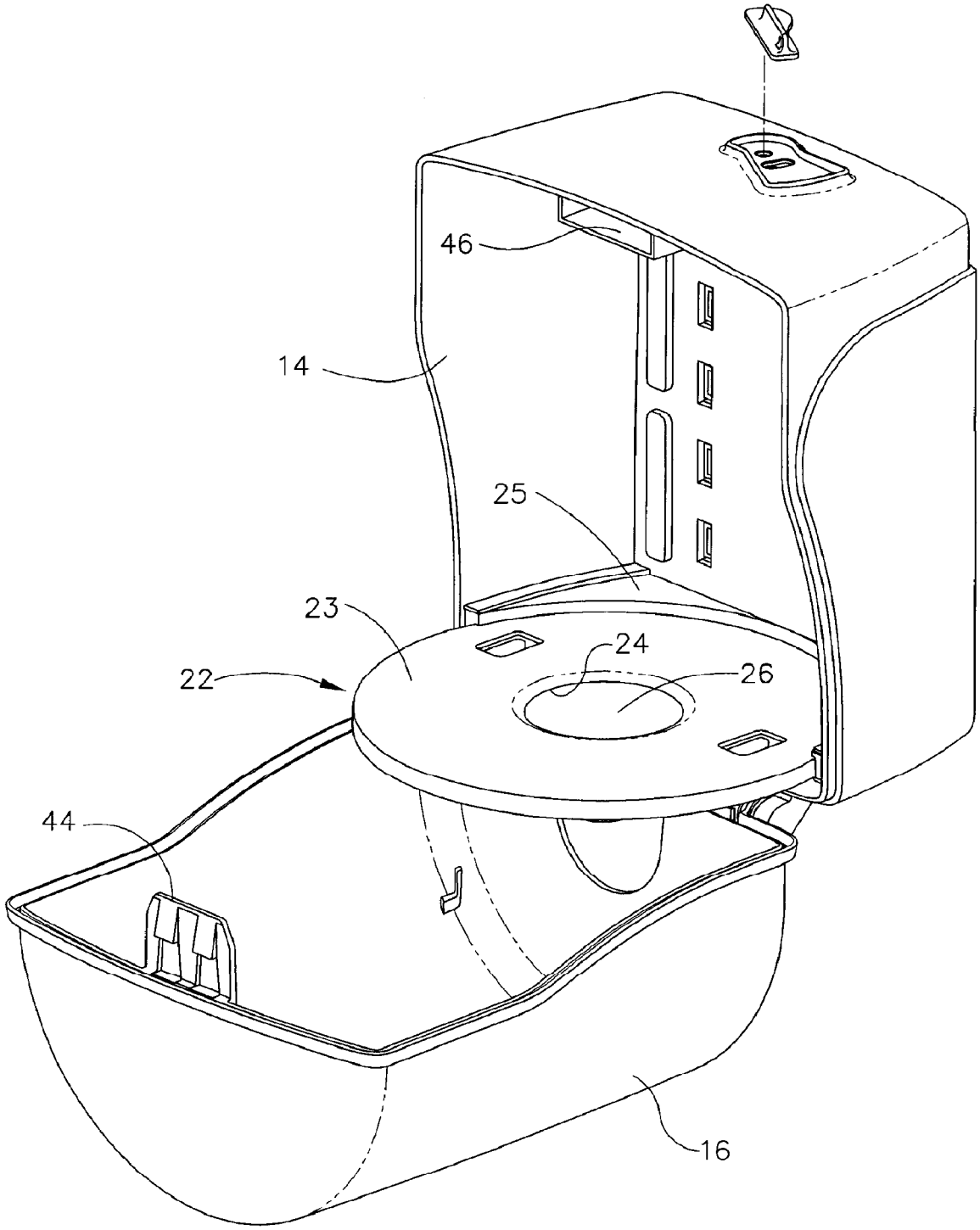
FIG. 6 is a front perspective view of the dispenser of FIG. 1 in an open position with a paper support tray connected to the housing back of the dispenser.
Figure 7:
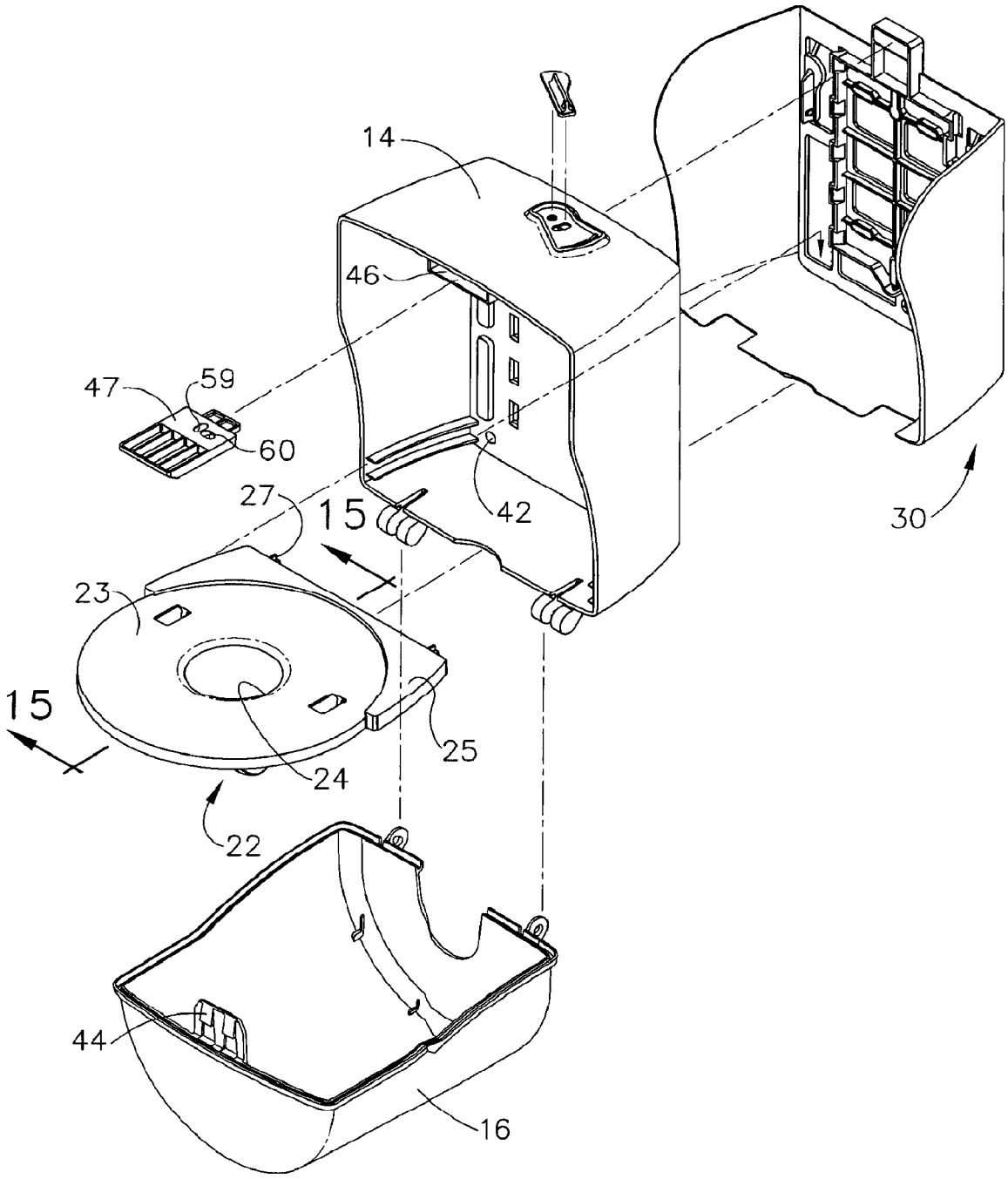
FIG. 7 is an exploded view showing detail of the assembly of the dispenser of FIG. 6.

FIG. 6 is a front perspective view of the dispenser of FIG. 1 in an open position. The dispenser comprises a paper support tray 22 removably connected to a lower portion of housing back 14. Support tray 22 has a generally planar top surface 23 for supporting a paper towel roll positioned inside the housing. When viewed from the top, support tray 22 has a generally circular front portion that typically fits close to but does not touch the inside of front cover 16 when the front cover is closed against the housing back. The back portion of support tray 22 comprises an integrally molded support piece 25, such as shown in FIG. 7. Support piece 25 has a generally rectangular-shaped back portion that fits inside the generally rectangular-shaped housing back 14 when the support tray is attached to the housing back, as described hereinafter. Of course, the support tray may be attached to or supported by the interior of the housing back by various other ways, with or without a support piece.

Figure 4:
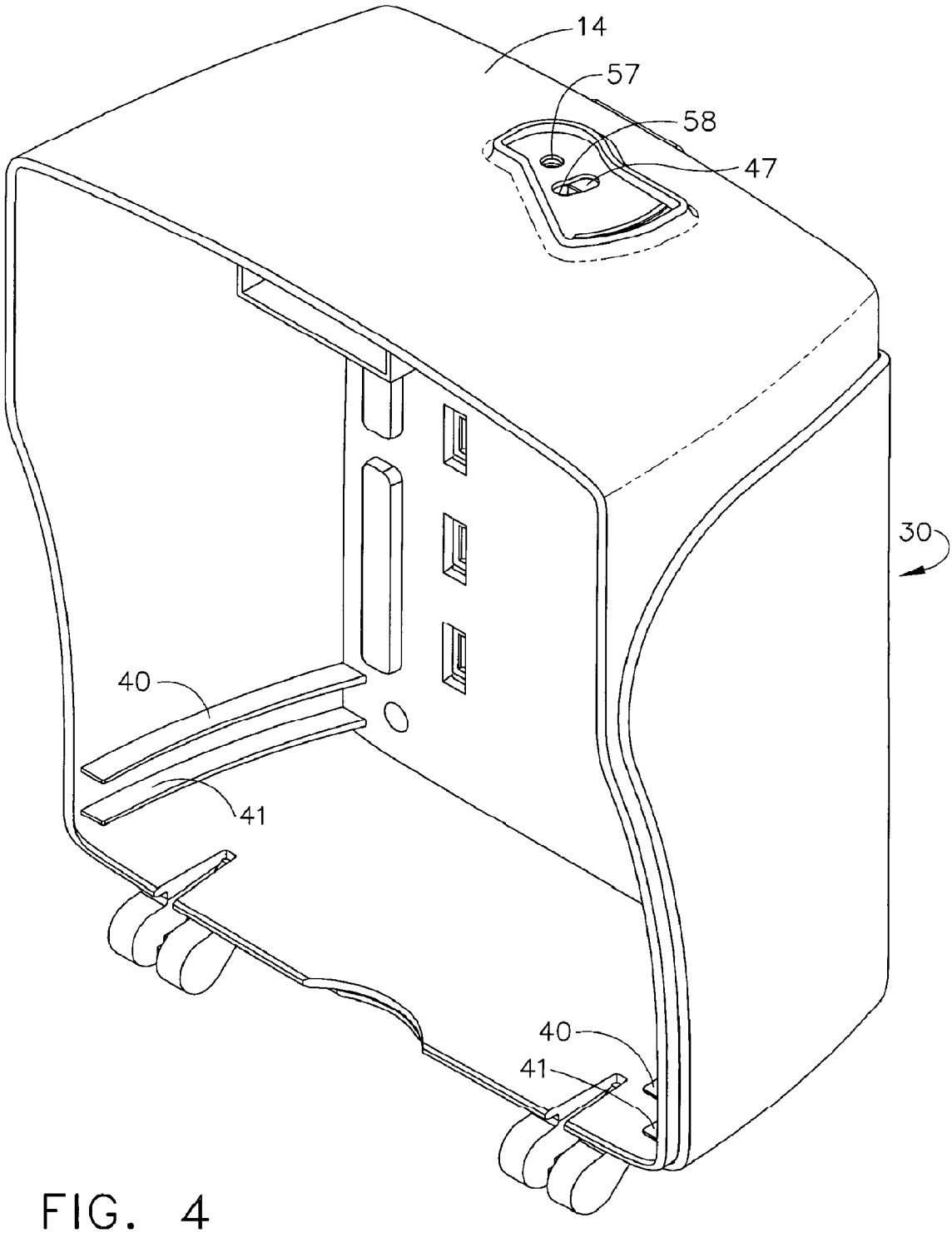
FIG. 4 is a perspective view of the wall-mounting member of FIG. 3 attached to the housing back of the dispenser of FIG. 1.

As shown in FIGS. 6 and 7, paper support tray 22 is connected to housing back 14 by sliding it between receiving ribs extending along at least one lower interior surface of the housing back. The receiving ribs hold the support tray in position to support the paper towel roll. As shown in FIGS. 4, 6 and 7, housing back 14 has upper rib members 40 and lower rib members 41 that extend along the interior sides of a lower portion of the housing back and hold or support paper support tray 22. Support piece 25 typically fits securely between upper and lower rib members 40 and 41 to hold support tray 22 in place. When front cover 16 is closed against housing back 14, the front portion of support tray 22 typically is adjacent the interior surface of the front cover. The support tray may ever touch the front cover so long as it does not prevent the front cover from being completely closed against the housing back. As shown in FIG. 7, the back side of support piece 25 may have posts 27 that fit within holes 42 in the housing back to further secure the support tray to the housing back.

Figure 15:
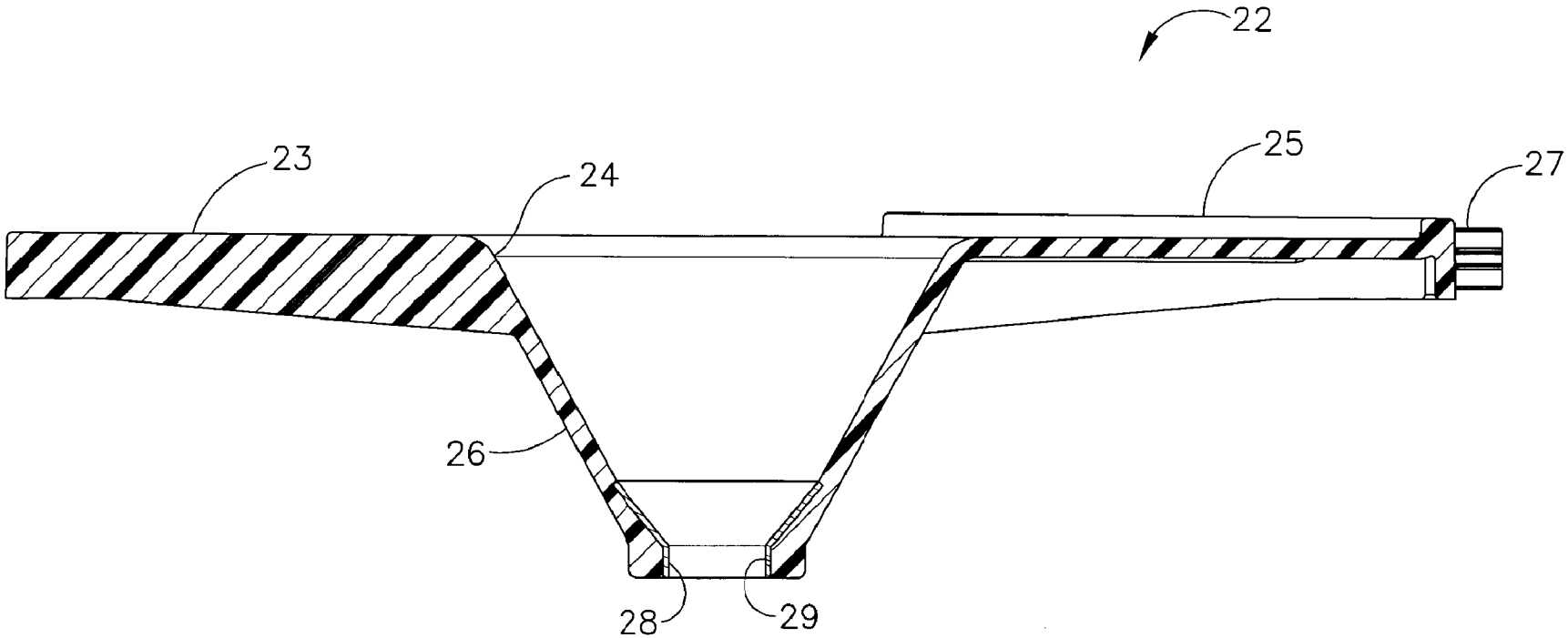
FIG. 15 is an enlarged sectional view of the paper support tray shown in FIG. 7 taken along line 15-15.
Figure 18:
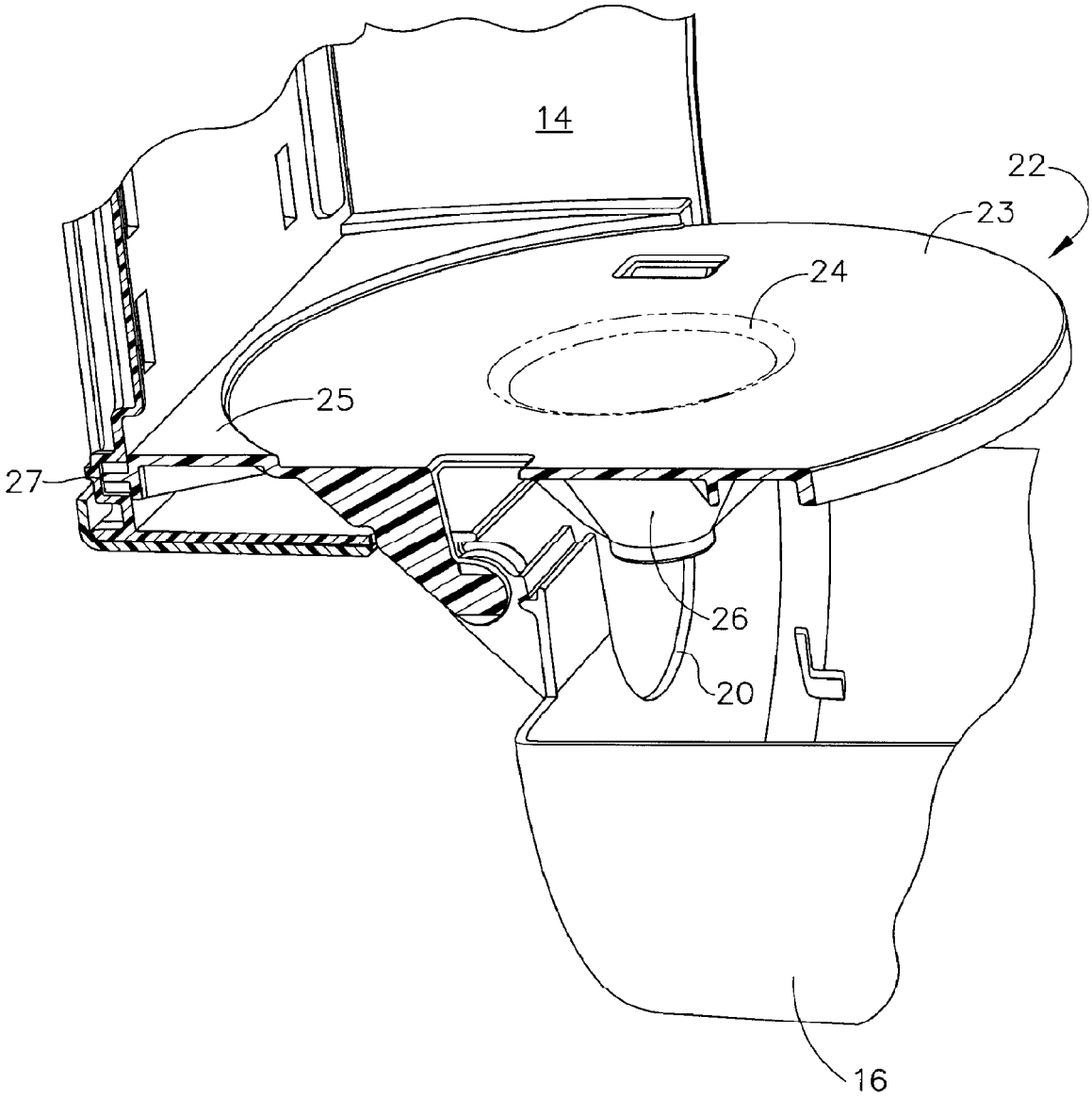
FIG. 18 is a partial sectional view of the paper support tray and lower portions of the front cover and housing back of the dispenser shown in FIG. 6.

As shown in FIGS. 6 and 15, paper support tray 22 has a centrally-located opening 24, a centrally-located dispensing nozzle 26, and a dispensing orifice 28 through which the leading edge of the roll of paper towels (referred to as the "tail" of the roll) is pulled by the user. When front cover 16 of housing 12 is closed against housing back 14, opening 20 in the lower periphery of the housing typically receives at least a lower portion of dispensing nozzle 26, as can be seen in FIGS. 18-19. In other designs, the dispensing nozzle may be located entirely within the housing, although the tail of the paper towel roll extends below the housing so it is accessible to the user. Dispensing nozzle 26 typically has a conical or funnel shape to help guide the sheets of the paper towel roll through dispensing orifice 28. As shown in FIG. 15, the funnel shaped nozzle 26 has a wide opening at the top surface 23 of the support tray and a narrow opening adjacent the dispensing orifice 28. Of course, other possible designs and structures for the dispensing outlet may be used in the present invention.

Once a paper towel roll is loaded into dispenser 10, front cover 16 of the housing can be closed against housing back 14 and locked. Closing the front cover also secures paper support tray 22 inside housing 12. When the user pulls the tail of the paper towel roll, the towels tear at the perforations, regardless of the thickness or grade of paper used and whether the paper is 1-ply, 2-ply, or 3-ply. It will be appreciated that the abrasiveness of the paper dispensed through dispensing orifice 28 may cause wear on the orifice. The rate of wear will depend on the frequency of use of the dispenser, the composition and design of the dispensing orifice, and the thickness and abrasiveness of the paper. In one embodiment, a protective liner made of a relatively hard, wear-resistant material, such as metal cone 29 shown in FIG. 15, is inserted inside or molded into the lower periphery of the dispensing nozzle 26. The tail of a paper towel roll extending through dispensing orifice 28 contacts the edge of the cone 29 and facilitates tearing of towels from the roll, particularly when the interior edge of cone 29 is sharp. A hardened plastic or metal cone also minimizes wear along the dispensing orifice due to frictional contact with the paper towels. In another embodiment, the protective liner comprises a washer made of a hard, wear-resistant material that is inserted or molded into the lower periphery of the dispensing nozzle.

Figure 16:
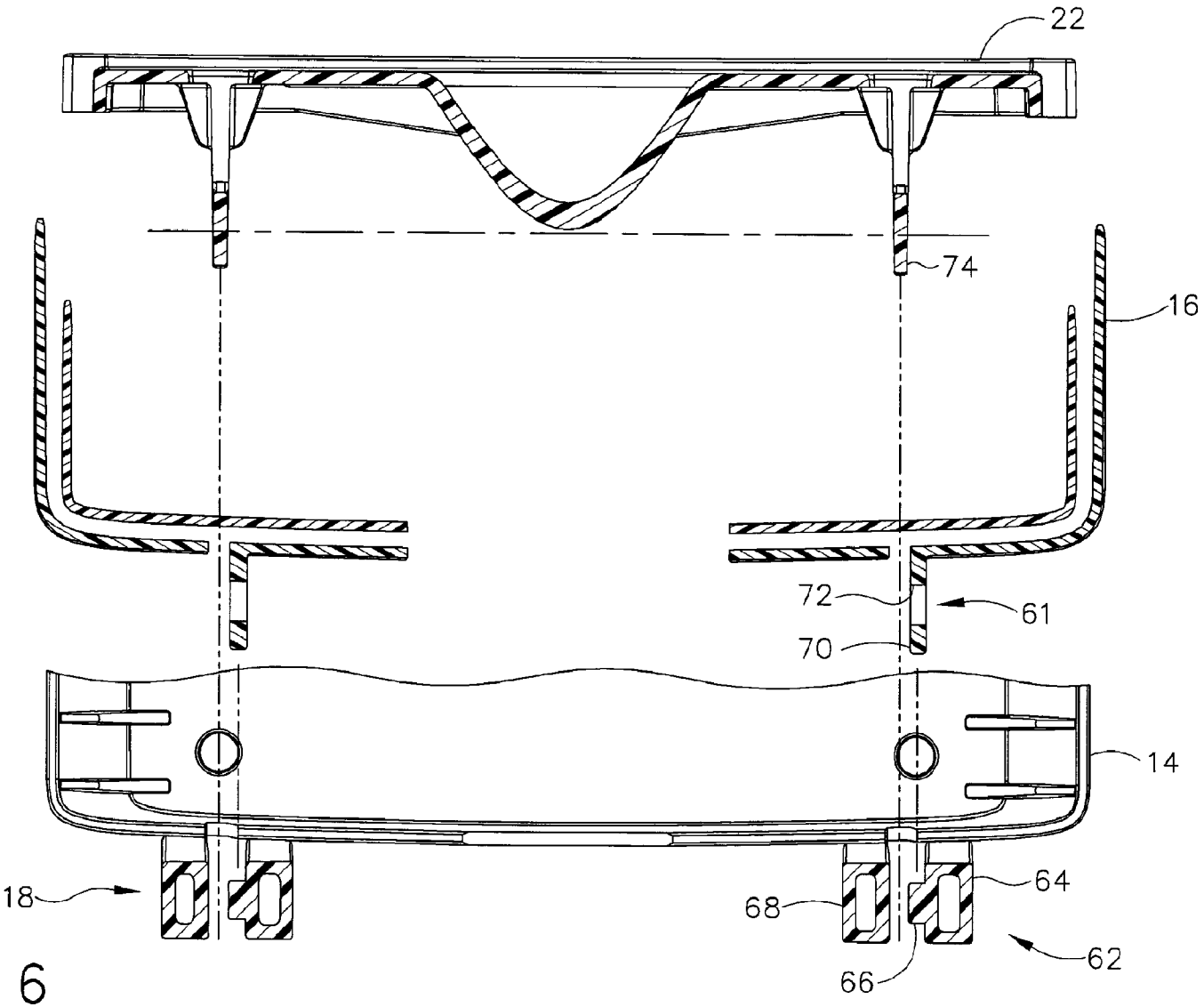
FIG. 16 is an exploded sectional view through the paper support tray and lower portions of the front cover and housing back of the dispenser shown in FIG. 6 when in a closed condition, showing detail of the hinge assembly.

As noted above, the front cover of the housing is hingedly connected to the housing back through hinges for opening and closing of the housing. Various hinges known in the art, e.g., those described in U.S. Pat. Nos. 7,275,672 and 6,869,041 and U.S. Patent Application Publication 2006/0261076 A1, all incorporated herein by reference, can be used in the present invention. In one embodiment, such as shown in FIG. 16, the paper support tray comprises at least one locking element for releasably locking at least one first hinge element on the lower periphery of the front cover of the housing to at least one second hinge element on the lower periphery of the housing back. As used herein, the term "hinge" refers to a jointed or flexible device that connects and permits pivoting or turning of a component relative to a stationary component. Hinges include plastic and metal pivotable connectors, such as those used to fasten a door to a frame, and living hinges. Living hinges may be constructed from plastic and formed integrally between two members. A living hinge permits pivotable movement of one member in relation to another connected member.

FIG. 16 is an exploded sectional view through paper support tray 22 and lower portions of front cover 16 and housing back 14 when the dispenser 10 is in a closed condition. As shown in FIG. 16, the dispenser comprises two hinges 18, each of which comprises a first hinge element 61 on the lower periphery of front cover 16 and a second hinge element 62 on the lower periphery of housing back 14. Second hinge element 62 comprises a pivot-post arm 64 having a horizontally extending pivot post 66 and an end-capping arm 68, with a space therebetween for receiving first hinge element 61. First hinge element 61 comprises pivot-ring arm 70 having a circular opening 72 therein for receiving pivot post 66. During assembly of the housing, the pivot-ring arms 70 are fit between pivot-post arms 64 and end-capping arms 68 and then moved horizontally so that pivot posts 66 fit through openings 72, thereby fitting pivot-ring arms 70 onto pivot-post arms 64.

Figure 17:
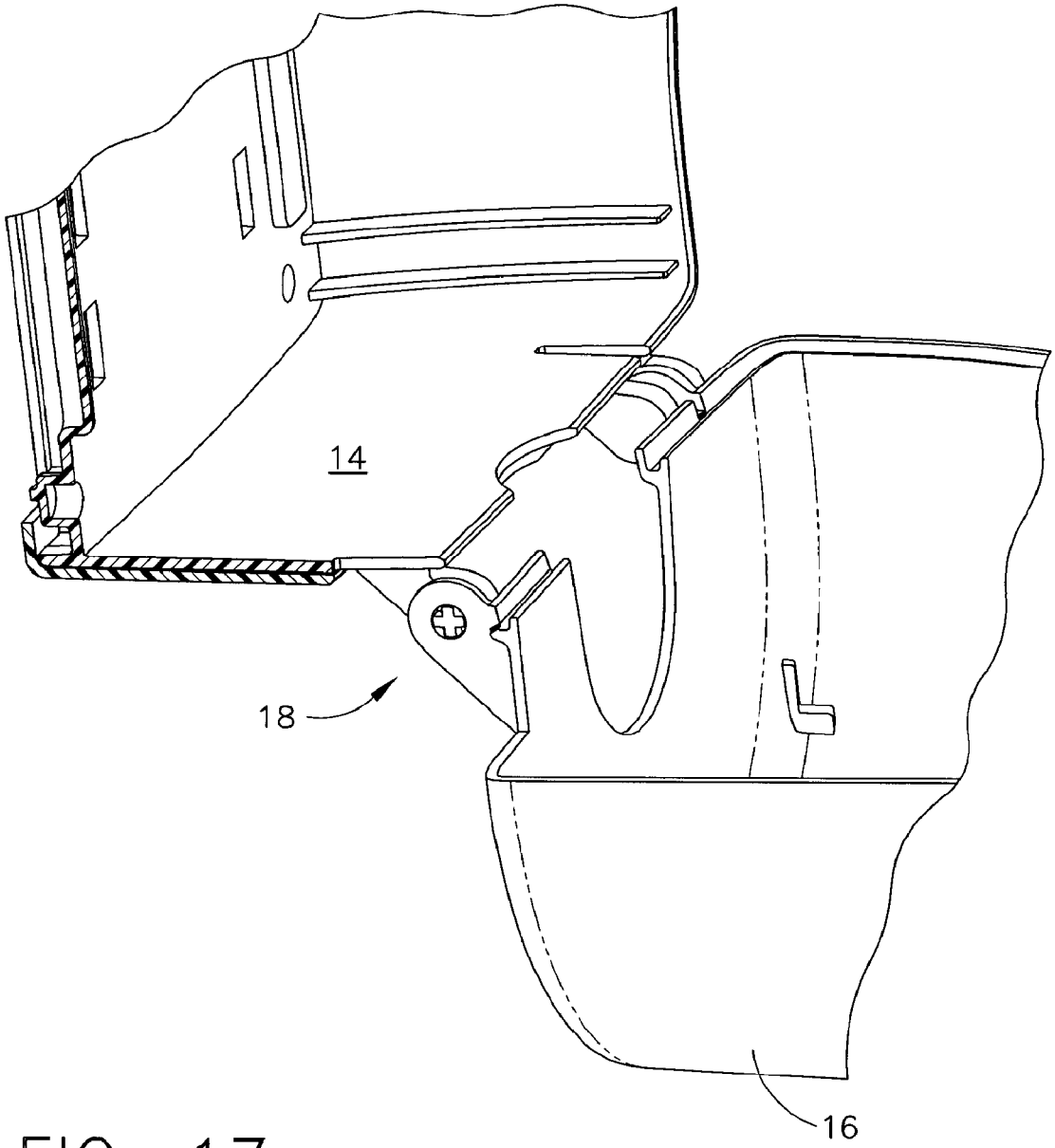
FIG. 17 is a partial sectional view of lower portions of the front cover and housing back of the dispenser shown in FIG. 5.

As also shown in FIG. 16, paper support tray 22 comprises locking elements such as locking arms 74 that releasably lock in place the first hinge elements 61 on the front cover against the second hinge elements 62 on the housing back. In this example, when paper support tray 22 is fit between upper and lower rib members 40 and 41, locking arms 74 are adjacent pivot-ring arms 70 and prevent them from slipping off pivot posts 66 as the first hinge elements 61 pivot about the second hinge elements 62. Locking arms 74 also are adjacent end-capping arms 68 to further secure the locking arms in place. When assembled, hinges 18 thus allow front cover 16 to pivot away from housing back 14 to permit access to the interior of the housing, including paper support tray 22 and the paper towel roll placed thereon. FIGS. 17 and 18 show partial sectional views of the lower portions of the front cover and housing back of dispenser 10, with and without the paper support tray. Removing paper support tray 22 from housing back 14 by sliding the tray out from rib members 40 and 41 also removes locking arms 74 from hinges 18. Pivot-ring arms 70 can then be slid off from pivot posts 66, allowing front cover 16 to be removed from housing back 14. The support tray and/or the front cover can thus be easily removed from the housing back, allowing service personnel to quickly clean or replace these parts of the dispenser as necessary. While the above embodiment describes a particular hinge design, it will be appreciated that other hinges and fastening mechanisms may be used in the present invention.

Figure 2:
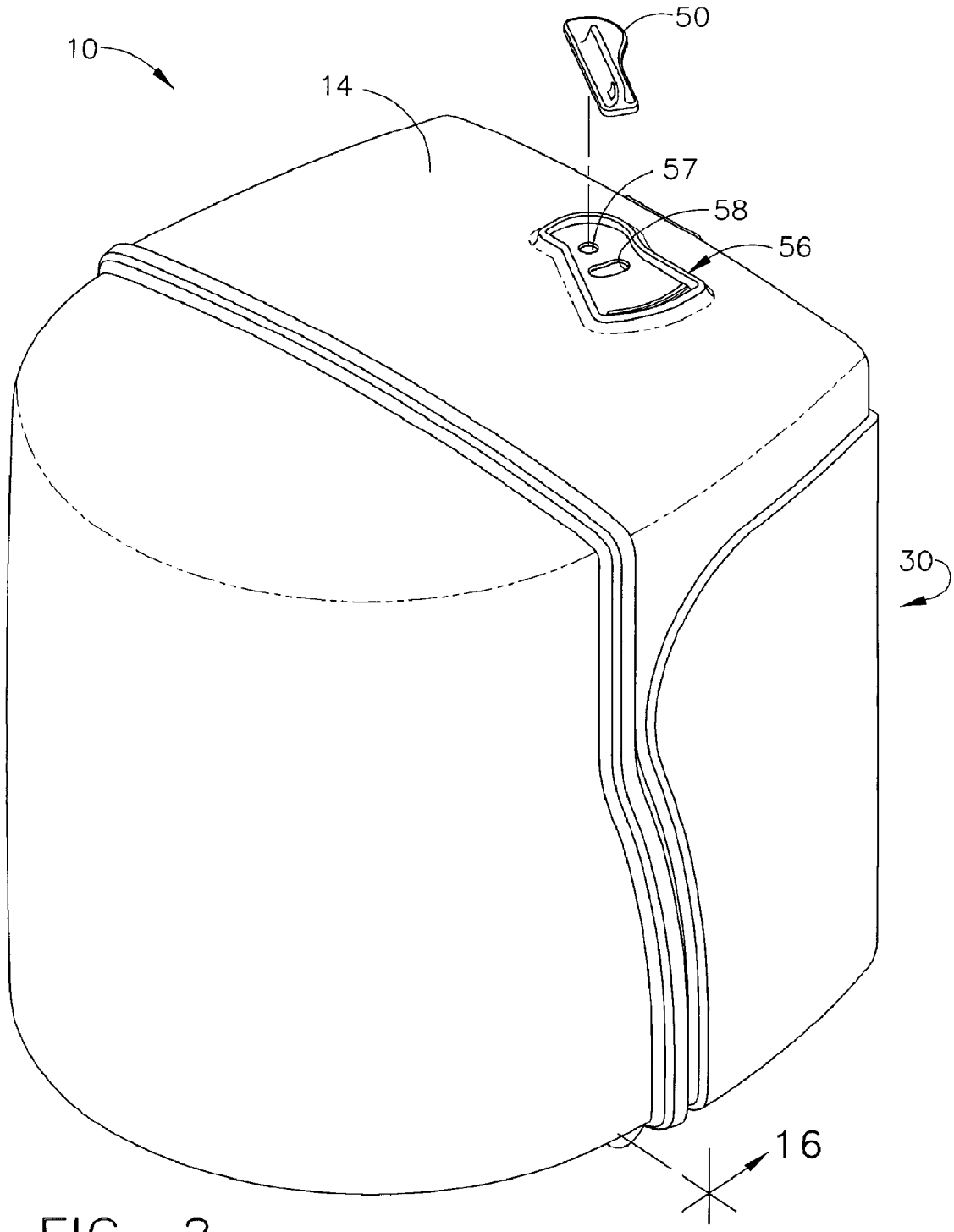
FIG. 2 is a front perspective view of the dispenser of FIG. 1 with an opening key shown detached from the locking member of the dispenser.
Figure 8:
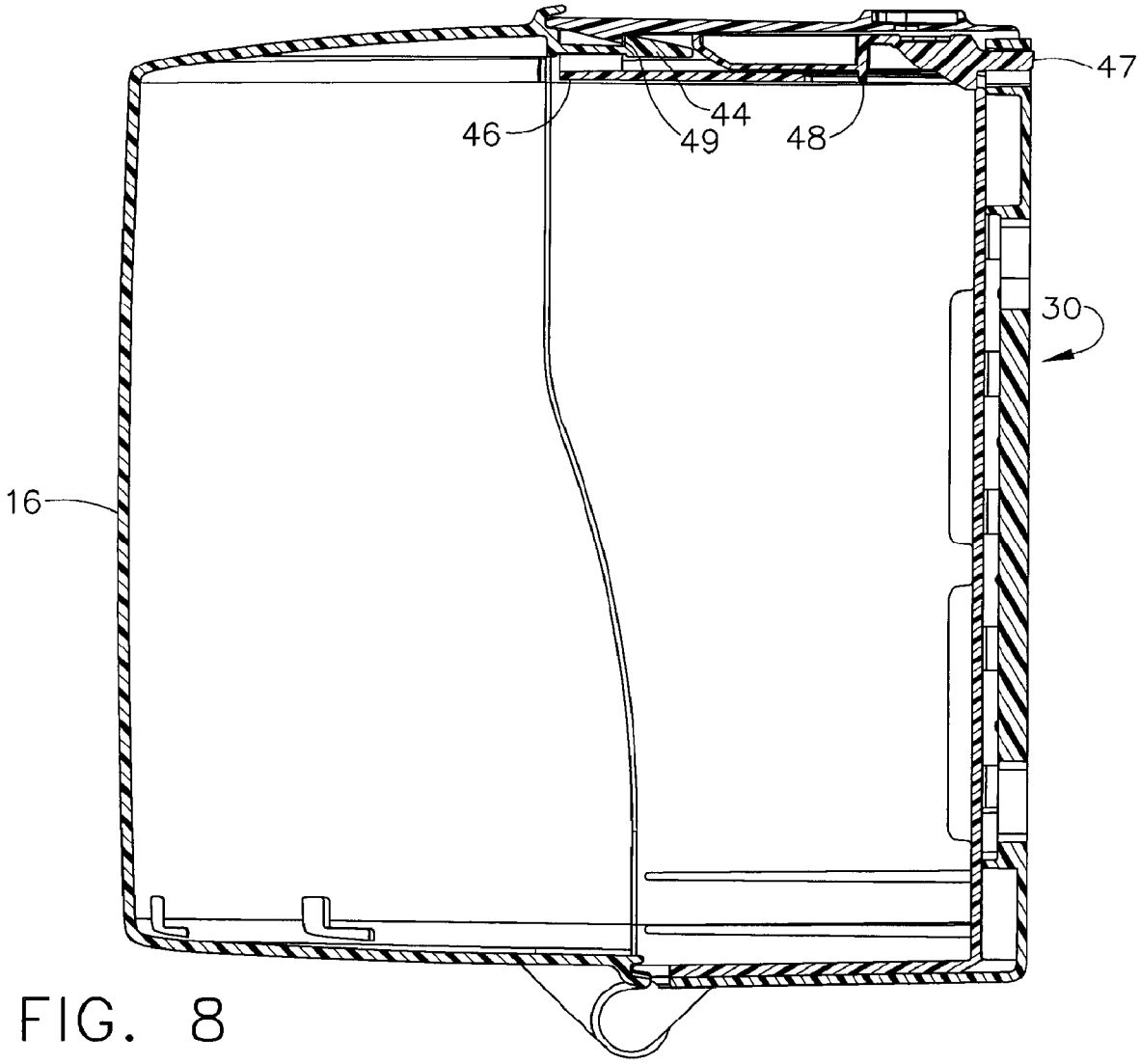
FIG. 8 is a sectional view through the horizontal center of the dispenser of FIG. 1 (without a paper support tray), with the front cover locked to the housing back.
Figure 9:
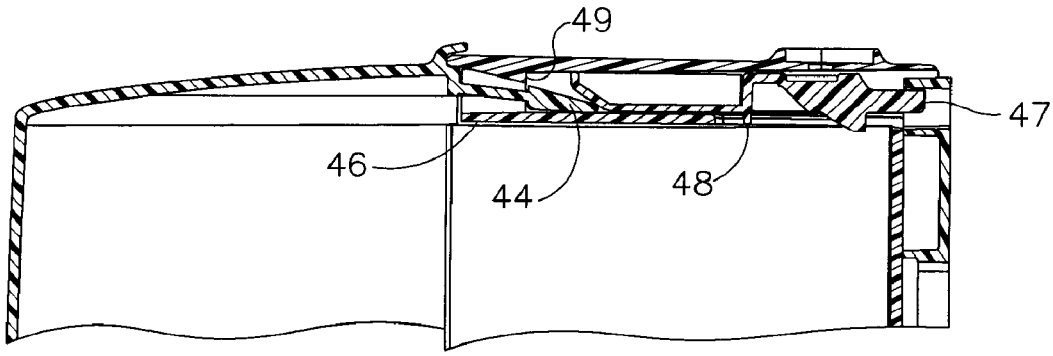
FIG. 9 is a partial sectional view through the horizontal center of the dispenser of FIG. 1, with the front cover unlocked from the housing back.
Figure 10:
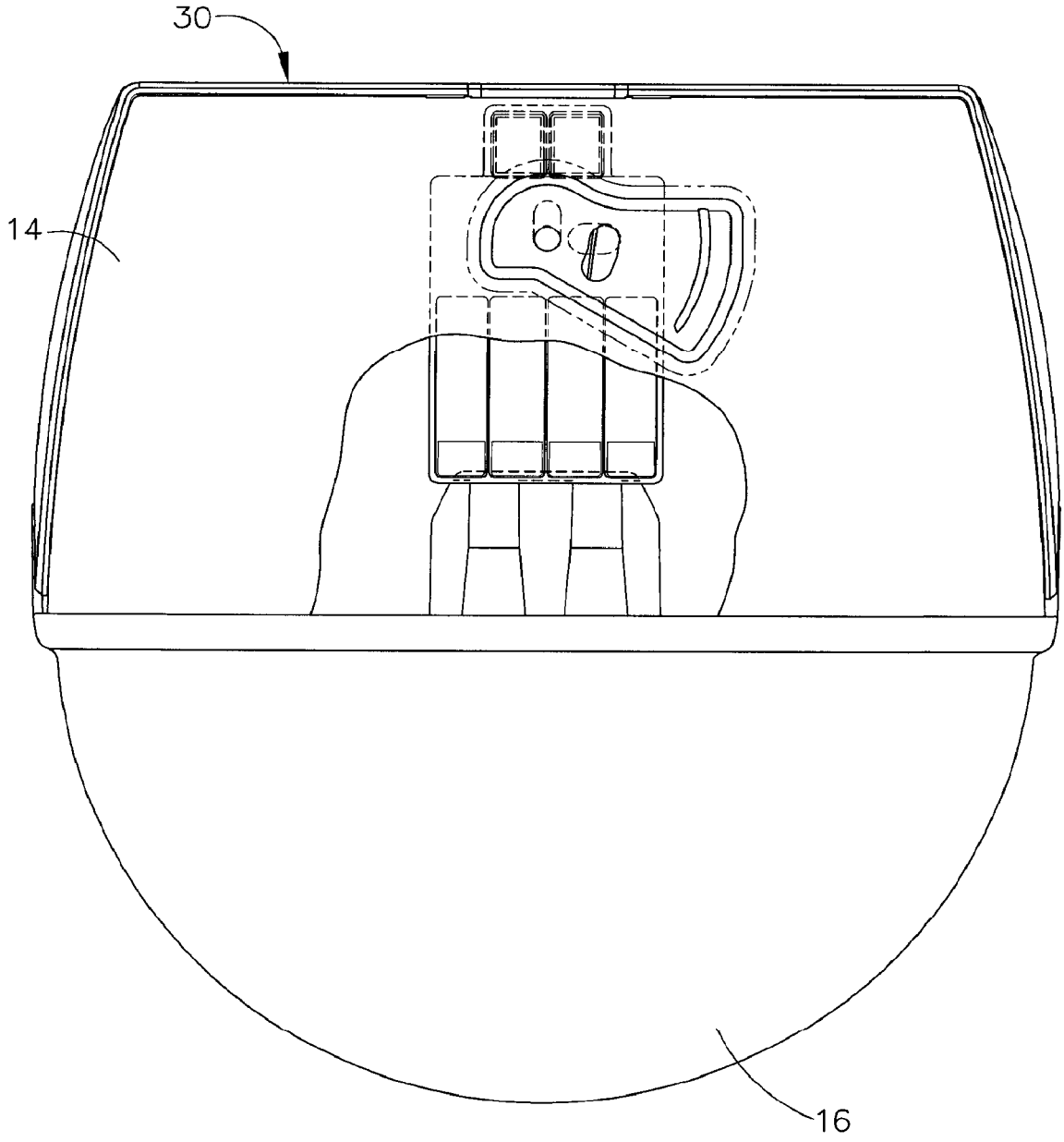
FIG. 10 is a top, cut-away view of the dispenser of FIG. 1, with the front cover locked to the housing back.
Figure 11:
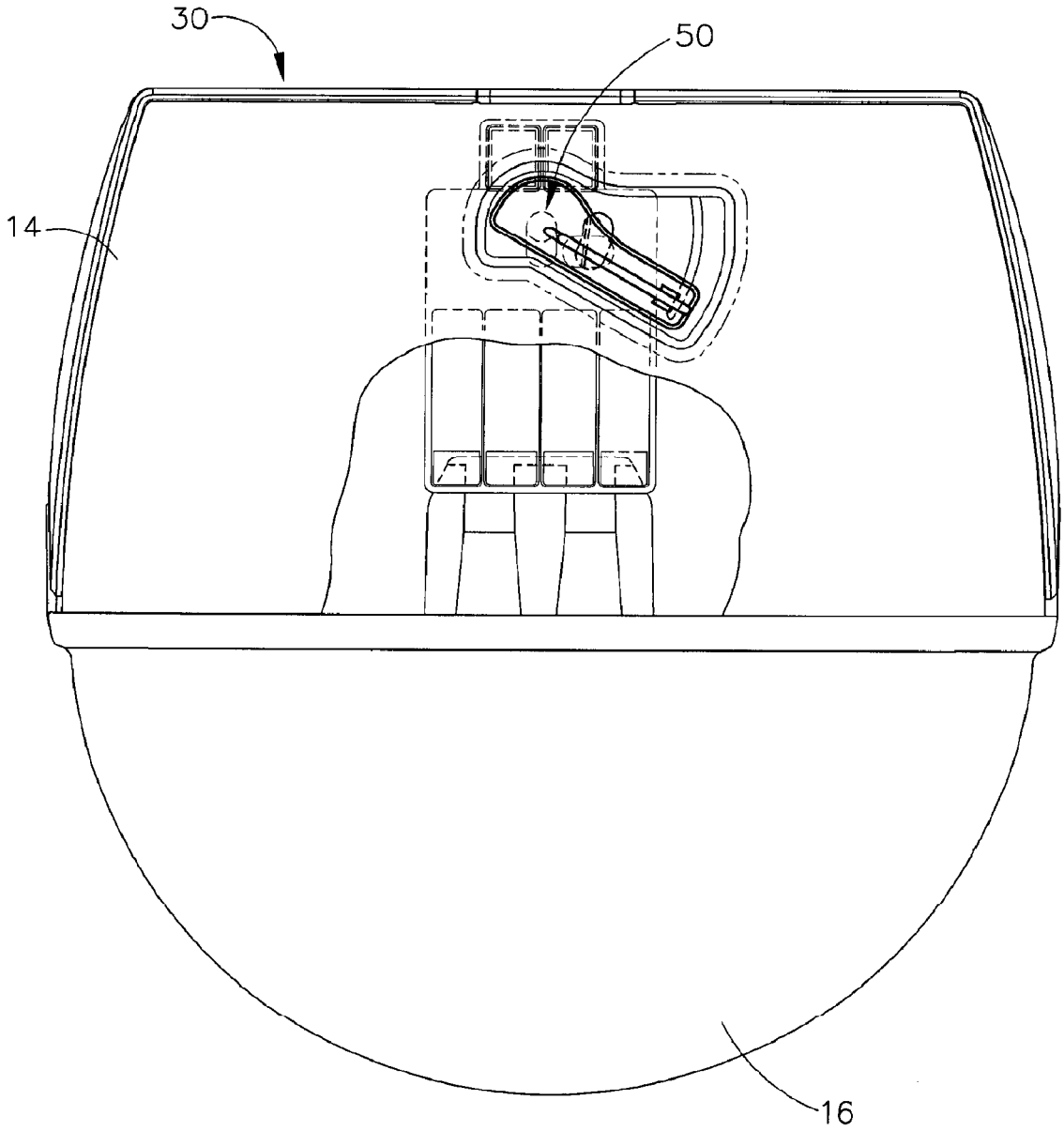
FIG. 11 is a top, cut-away view of the dispenser of FIG. 1, with the front cover unlocked from the housing back.
Figure 12:
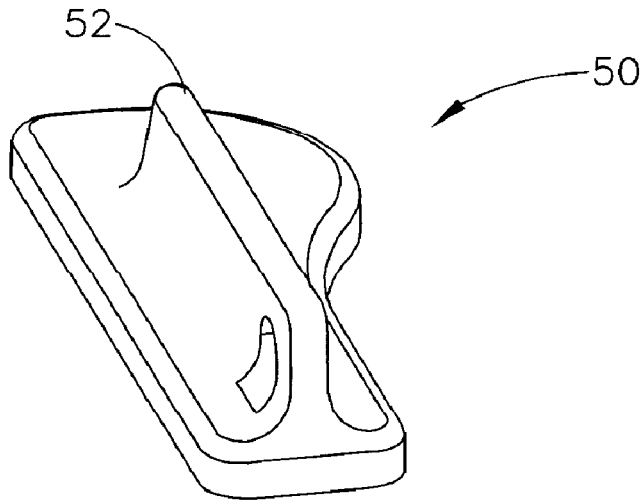
FIG. 12 is an enlarged perspective view of the opening key show in FIG. 1.
Figure 13:
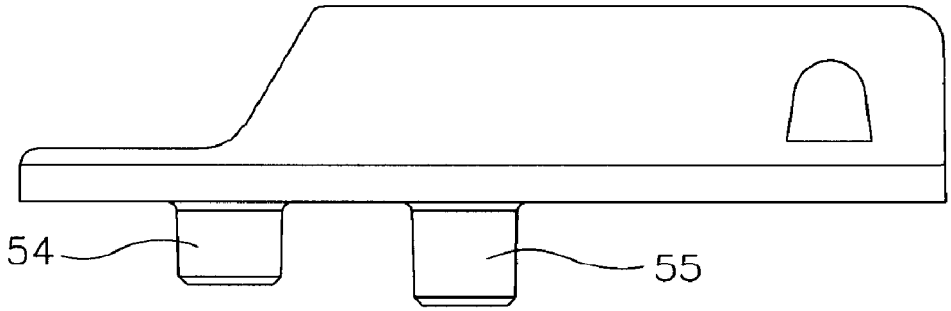
FIG. 13 is side view of the key of FIG. 12.
Figure 14:
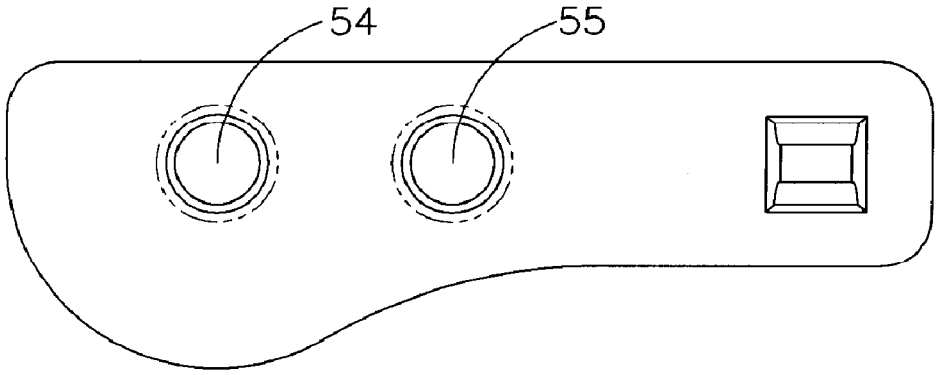
FIG. 14 is a bottom view of the key of FIG. 13.

As noted above, FIG. 1 shows a center-pull dispenser of the present invention in a closed and locked condition. When the locking member 56 is unlocked by key 50, front cover 16 of the housing is released and swings down from housing back 14 to provide access to the interior of the housing, as shown in FIG. 6. As shown in FIGS. 12-14, key 50 has a grip 52, a pivot post 54 that fits within receiving hole 57 shown in FIG. 2, and a post 55 that fits within receiving channel 58. Pivot post 54 and post 55 also fit within holes 59 and 60, respectively, in slide bar 47 located in channel 46 of the housing back, as shown in FIG. 7. When the dispenser is in a locked position, key 50 can be inserted into locking member 56 so that pivot post 54 fits within holes 57 and 59, and post 55 fits within channel 58 and hole 60. When key 50 is turned clockwise toward the user, post 55 pushes slide bar 47 forward in channel 46 toward the front cover of the housing. The front end of slide bar 47 has a beveled surface that pushes a mating beveled surface on a flexible locking tongue 44 (shown in FIGS. 6 and 7) attached to the interior surface of the top portion of front cover 16, down and away from the housing back so the locking tongue is no longer held by locking detente 49 (shown in FIGS. 8 and 9) in channel 46. Depressing the locking tongue in this manner releases the front cover from the housing back, as shown in FIGS. 9 and 11. The locking member is thus unlocked by motion of the key pushing the slide bar in the channel, which pushes the locking tongue down and away from the housing back to release the front cover from the housing back. To lock the front cover to the housing back, locking tongue 44 is inserted into channel 46 until it engages locking detente 49, as shown in FIGS. 8 and 10. As also shown in FIG. 8, the underside of slide bar 47 has a grip 48 that can be used to pull the slide bar toward the user when the front cover is unlocked from the housing back and the key is removed from the locking member. Pulling the grip 48 toward the user pulls slide bar 47 away from latch 38 (shown in FIGS. 3 and 7), thereby vertically unlocking the housing back from wall-mounting member 30 so the housing back can be slid vertically upward to disengage catches 39 from catches 37. The housing back can then be horizontally pulled away from the wall-mounting member without removing the mounting member from the wall.

Dispenser 10 is typically mounted on a wall by first attaching wall-mounting member 30 to a wall surface. Housing back 14 is then fit inside the wall-mounting member flush against the back bracket 35. The housing back is slid down to engage catches 39 with catches 37, horizontally locking the housing back to the wall-mounting member. Slide bar 47 is then pushed toward the wall to engage latch 38 and vertically lock the housing back to the wall-mounting member. Front cover 16 is then attached to the housing back by fitting pivot-ring arms 70 between pivot-post arms 64 and end-capping arms 68. The pivot-ring arms are moved horizontally so that pivot posts 66 fit inside openings 72, thereby fitting the pivot-ring arms onto the pivot-post arms. Support piece 25 of paper support tray 22 is then fit between upper and lower rib members 40 and 41 of the housing back, which simultaneously inserts locking arms 74 against pivot-ring arms 70 to prevent them from slipping off pivot posts 66. Locking arms 74 also abut against end-capping arms 68, completing hinges 18 and releasably locking the first hinge elements 61 of the front cover to the second hinge elements 62 of the housing back. Hinges 18 thus allow front cover 16 to pivot toward or away from housing back 14. After a paper towel roll is placed on the paper support tray, the front cover of the dispenser is closed against the housing back. As described above, when the front cover is closed against the housing back, locking tongue 44 is inserted into channel 46 and engages locking detente 49, thereby locking the front cover to the housing back. To unlock the dispenser, key 50 is inserted into locking member 56 and rotated clockwise toward the user, as described above. The front cover can then be pivoted away from the housing back to expose the interior of the housing. The disperser may then be cleaned and/or refilled with a new paper towel roll. The dispenser may be removed from the wall by reversing the assembly and mounting steps described above.

The invention thus provides a simple and reliable paper towel dispenser that does not require any action by the user other than pulling out the paper towel. Since the dispenser has no metering mechanism with moving parts, it should be more reliable and less expensive to manufacture than other dispensers. The dispenser can be quickly mounted to or removed from a wall by service personnel. The housing can be easily opened for refilling, and the housing or just the front cover and/or the paper support tray can be quickly removed from the mounted dispenser and cleaned or replaced without removing the wall-mounting member or the housing back from the wall.

The invention also provides a method for dispensing a paper towel from a continuous roll of paper towels having a plurality of spaced apart lines of perforations therebetween defining individual paper towels. The method includes the step of placing the roll of paper towels in a dispenser housing having a housing back and a front cover hingedly connected thereto for opening and closing the housing. The method continues by inserting a tail of the paper towel roll through a dispensing orifice for a dispensing nozzle positioned along a lower periphery of the housing. Upon closing the housing, the tail inserted through the dispensing orifice is accessible to the user. Pulling the tail through the dispensing orifice causes sufficient friction against the paper to tear the roll along a line of perforations so as to dispense a single towel.

The invention also provides a method for mounting the center-pull dispenser to a wall by following the above-described steps.

The drawings and specification describe various embodiments of the invention. Although specific terms are employed, the terms are used in a descriptive sense only and not for purposes of limitation. The invention has been described in detail with specific reference to the illustrated embodiments. It will be apparent, however, that various modifications and changes can be made within the spirit and scope of the invention as described in the specification and as defined in the appended claims.

What is claimed is:

1. A center-pull dispenser for dispensing paper towels from a continuous roll wherein each individual towel is separated from an adjoining towel by a plurality of perforations, said dispenser comprising:

a) a housing having a housing back and a detachable front cover hingedly connected thereto at the lower periphery of said housing back and front cover for opening and closing said housing;

b) a paper support tray removably connected to a lower portion of the housing back, said support tray having (1) a generally planar top surface, (2) a centrally located dispensing nozzle having an orifice for dispensing individual towels therethrough, and (3) locking arms for releasably locking first hinge elements on the lower periphery of said front cover against second hinge elements on the lower periphery of said housing back;

c) an opening in the lower periphery of said housing through which the towels are dispensed; and d) a wall-mounting member for removably mounting the housing back to a wall.

2. The dispenser of claim 1 wherein the paper support tray is removably connected to the housing back by sliding it between receiving ribs extending along at least one lower interior surface of the housing back.

3. The dispenser of claim 1 wherein the second hinge elements on the housing back comprise a pivot-post arm having a horizontally extending pivot post and an end-capping arm, with a space therebetween for receiving the first hinge elements on the front cover.

4. The dispenser of claim 1 wherein the dispensing nozzle has a wear-resistant plastic or metal cone inserted or molded into its lower periphery.

5. The dispenser of claim 1 wherein the first hinge elements on the front cover comprise a pivot-ring arm having a circular opening therein for receiving a horizontally extending pivot post on the second hinge elements on the housing back.

6. The dispenser of claim 5 wherein the second hinge elements on the housing back comprise a pivot-post arm having a horizontally extending pivot post and an end-capping arm, with a space therebetween for receiving the first hinge elements on the front cover.

7. The dispenser of claim 1 wherein the locking arms are adjacent the pivot-ring arms and prevent them from slipping off the pivot posts as the first hinge elements pivot about the second hinge elements.

8. The dispenser of claim 7 wherein the paper support tray is removably connected to the housing back by sliding it between receiving ribs extending along at least one lower interior surface of the housing back.

9. The dispenser of claim 1 wherein the housing and the housing back are removable from the wall without removing the wall-mounting member from the wall.

10. The dispenser of claim 9 wherein the wall-mounting member has a plurality of outwardly-protruding catches on its interior side that engage a plurality of inwardly-protruding catches on the exterior side of the housing back to horizontally lock the housing back to the wall-mounting member.

11. The dispenser of claim 10 wherein the wall-mounting member has a latch for receiving a slide bar on the housing back to vertically lock the housing back to the wall-mounting member.

12. A center-pull dispenser for dispensing paper towels from a continuous roll wherein each individual towel is separated from an adjoining towel by a plurality of perforations, said dispenser comprising:

a) a housing having a housing back and a detachable front cover hingedly connected thereto at the lower periphery of said housing back and front cover for opening and closing said housing;

b) a paper support tray removably connected to a lower portion of the housing back by sliding it between receiving ribs extending along at least one lower interior surface of the housing back, said support tray having (1) a generally planar top surface, (2) a centrally located dispensing nozzle having an orifice for dispensing individual towels therethrough, and (3) locking arms for releasably locking first hinge elements on the lower periphery of said front cover against second hinge elements on the lower periphery of said housing back;

c) an opening in the lower periphery of said housing through which the towels are dispensed; and d) a wall-mounting member for removably mounting the housing back to a wall.

13. The dispenser of claim 12 wherein the second hinge elements on the housing back comprise a pivot-post arm having a horizontally extending pivot post and an end-capping arm, with a space therebetween for receiving the first hinge elements on the front cover.

14. The dispenser of claim 13 wherein the first hinge elements on the front cover comprise a pivot-ring arm having a circular opening therein for receiving a horizontally extending pivot post on the second hinge elements on the housing back.

15. The dispenser of claim 14 wherein the locking arms are adjacent the pivot-ring arms and prevent them from slipping off the pivot posts as the first hinge elements pivot about the second hinge elements.

16. The dispenser of claim 15 wherein the wall-mounting member has a plurality of outwardly-protruding catches on its interior side that engage a plurality of inwardly-protruding catches on the exterior side of the housing back to horizontally lock the housing back to the wall-mounting member, and a latch for receiving a slide bar on the housing back to vertically lock the housing back to the wall-mounting member.

17. The dispenser of claim 16 wherein the dispensing nozzle has a wear-resistant plastic or metal cone inserted or molded into its lower periphery.

18. The dispenser of claim 16 wherein the wall-mounting member has a plurality of outwardly-protruding catches on its interior side that engage a plurality of inwardly-protruding catches on the exterior side of the housing back to horizontally lock the housing back to the wall-mounting member, and a latch for receiving a slide bar on the housing back to vertically lock the housing back to the wall-mounting member.

19. The dispenser of claim 18 wherein the dispensing nozzle has a wear-resistant plastic or metal cone inserted or molded into its lower periphery.

20. A center-pull dispenser for dispensing paper towels from a continuous roll wherein each individual towel is separated from an adjoining towel by a plurality of perforations, said dispenser comprising:

a) a housing having a housing back and a detachable front cover hingedly connected thereto at the lower periphery of said housing back and front cover for opening and closing said housing;

b) a paper support tray removably connected to a lower portion of the housing back by sliding it between receiving ribs extending along at least one lower interior surface of the housing back, said support tray having (1) a generally planar top surface, (2) a centrally located dispensing nozzle having an orifice for dispensing individual towels therethrough, and (3) locking arms for releasably locking first hinge elements on the lower periphery of said front cover against second hinge elements on the lower periphery of said housing back;

c) an opening in the lower periphery of said housing through which the towels are dispensed;

d) a detachable wall-mounting member for removably mounting the housing back to a wall; and e) a locking member for releasably locking the front cover to the housing back and the housing back to the wall-mounting member.

* * * * *